United States Patent [19]

Kassai

[11] Patent Number: 4,958,885

[45] Date of Patent: Sep. 25, 1990

[54] HIGH CHAIR

[75] Inventor: Kenzou Kassai, Osaka, Japan

[73] Assignee: Aprica Kassai Kabushikikaisha, Osaka, Japan

[21] Appl. No.: 880,164

[22] Filed: Jun. 30, 1986

[30] Foreign Application Priority Data

Jul. 19, 1985 [JP] Japan ..... 60-111291

[51] Int. Cl.[5] ..... A47C 4/00

[52] U.S. Cl. ..... 297/55; 257/16; 257/345

[58] Field of Search ..... 297/16, 55, 345, 335, 297/154; 243/354.5, 455, 408; 403/108, 328, 325

[56] References Cited

U.S. PATENT DOCUMENTS

| | | | |
|---|---|---|---|
| 303,875 | 8/1884 | Mason | 297/55 X |
| 416,324 | 12/1889 | Cross | 297/345 X |
| 703,792 | 7/1902 | Johnston | 297/345 X |
| 937,567 | 10/1909 | Canouts | 297/55 |
| 1,399,835 | 12/1921 | Willems | 297/335 |
| 1,568,477 | 1/1926 | Small | 297/55 |
| 1,621,930 | 3/1927 | Hoy . | |
| 2,495,843 | 1/1950 | Glenn | 297/154 |
| 2,624,395 | 1/1953 | Johnson | 297/345 X |
| 2,692,637 | 10/1954 | Rainwater | 297/345 |
| 2,767,774 | 10/1956 | Derby | 297/345 X |
| 2,812,614 | 11/1957 | Ladyman . | |
| 2,834,404 | 5/1958 | Groome | 297/345 |
| 3,427,069 | 2/1969 | McDonald . | |
| 3,542,419 | 11/1970 | Spinola | 297/345 X |
| 3,625,563 | 12/1971 | Dickinson | 297/345 X |
| 4,165,854 | 8/1979 | Duly | 403/328 X |

FOREIGN PATENT DOCUMENTS

| | | |
|---|---|---|
| 0111468 | 6/1984 | European Pat. Off. . |
| 1144460 | 10/1957 | France . |
| 2416673 | 9/1979 | France . |
| 2445125 | 7/1980 | France . |
| 2530437 | 7/1983 | France . |

*Primary Examiner*—Peter A. Aschenbrenner

*Attorney, Agent, or Firm*—W. G. Fasse; D. H. Kane, Jr.

[57] ABSTRACT

A high chair has a backrest member and a seat member which constitute a seat section, and a support member which is disposed to overlap the backrest member and which supports the backrest member for vertical slide movement. The support member is fixed in its raised position by a raised position fixing device. In the region where the backrest member and the support member overlap each other, the support member has a through-hole. On the other hand, a plurality of vertically aligned engaging holes are provided in the backrest member at positions where they can be opposed to the through-hole. A lock pin is inserted into the through-hole and one of the engaging holes, thereby fixing the height of the backrest member.

9 Claims, 9 Drawing Sheets

HIGH CHAIR

BACKGROUND OF THE INVENTION

1. Field of the Invention

This invention relates to a high chair wherein the seat is located at a relatively high level so that a child sitting on the seat, is maintained at a position suitable for the height of an adult table or the like. Thus, a child seated on this high chair is enabled to use the same table as adults.

2. Description of the Prior Art

The relationship between a chair to be used for dining or the like by a child and the stages of growth of the child will now be considered.

Generally, in a stage where a child is fed with baby food, the baby may be seated on a low chair. By a low chair is meant a chair having a seat located at such a low level as to enable a person feeding the baby to also sit at a low level such as a straw matting on the floor, to feed the child.

As the child grows to reach a stage ranging from the time when the child has learned to walk to the time the child enters kindergarten, the child will frequently be seated on a high chair for eating.

As the child further grows to reach a stage where the child goes to kindergarten or elementary school, the child will normally be seated on an adult chair for eating purposes.

However, in a stage where the child is a toddler even if the child is seated on a high chair, the level of the seat section is usually insufficient for the child to be maintained in a position suitable for the height of an adult table or the like. On the other hand, when the child has grown to reach the stage of graduating from kindergarten, the child may have become so large that the level of the seat section of a high chair is higher than is required for the child at this age. In other words, conventional high chairs have their seat sections at a fixed level. Therefore, it follows that although a child's body well matches with the level of the seat section of a high chair in a certain stage of growth, the seat section of said high chair may be much lower or higher than is required for children who are in other stages of growth.

Further, when a child has grown old enough to become of kindergarten or school age the child's body may have become too large for further use of a high chair. As a result, an adult chair would be used for the child to dine, but the seat section of such an adult chair would still be at a level too low to be comfortable for kindergarten or school age children.

SUMMARY OF THE INVENTION

Accordingly, it is an object of this invention to provide a high chair having a seat section the height or seat level of which can be changed according to the growth of children. Preferably, the high chair is so constructed and arranged so that the level of the seat section can be reduced until the chair can be used also as a low chair, if desired.

A high chair according to this invention comprises a backrest member and a seat member which constitute a seat section, and a support member which is disposed to overlap said backrest member and which supports said backrest member for a vertical sliding movement. The support member is fixed in its raised position by raised position fixing means.

In the region where the backrest member and the support member overlap each other, the support member is provided with a through-hole while the backrest member positioned in opposed relationship to the through-hole is provided with a plurality of longitudinally aligned engaging holes. A lock pin is inserted through the through-hole and one of the engaging holes, whereby the height of the backrest member is fixed. Moving the lock pin and removing it from the engaging hole allows a sliding movement of the backrest member relative to the support member. When the backrest member is has reached a predetermined position with another engaging hole in alignment with the through-hole, the lock pin is again inserted in the through-hole and the engaging hole, for fixing the seat section at another level.

According to this invention, the seat member and the backrest member which constitute the seat section are slidably supported by the support member, and the backrest member can be fixed at a suitable height or level by the lock pin. Thus, the level of the seat section can be changed according to the growth of children. Therefore, no matter in what stage of growth a child is, the seat level of the high chair can be made to match with the size of the child's body.

Further, in a preferred form of the invention, the seat level can be reduced to be equal to the level of a low chair, whereby the present chair may function as a high chair or as a low chair.

These object and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figure 1:
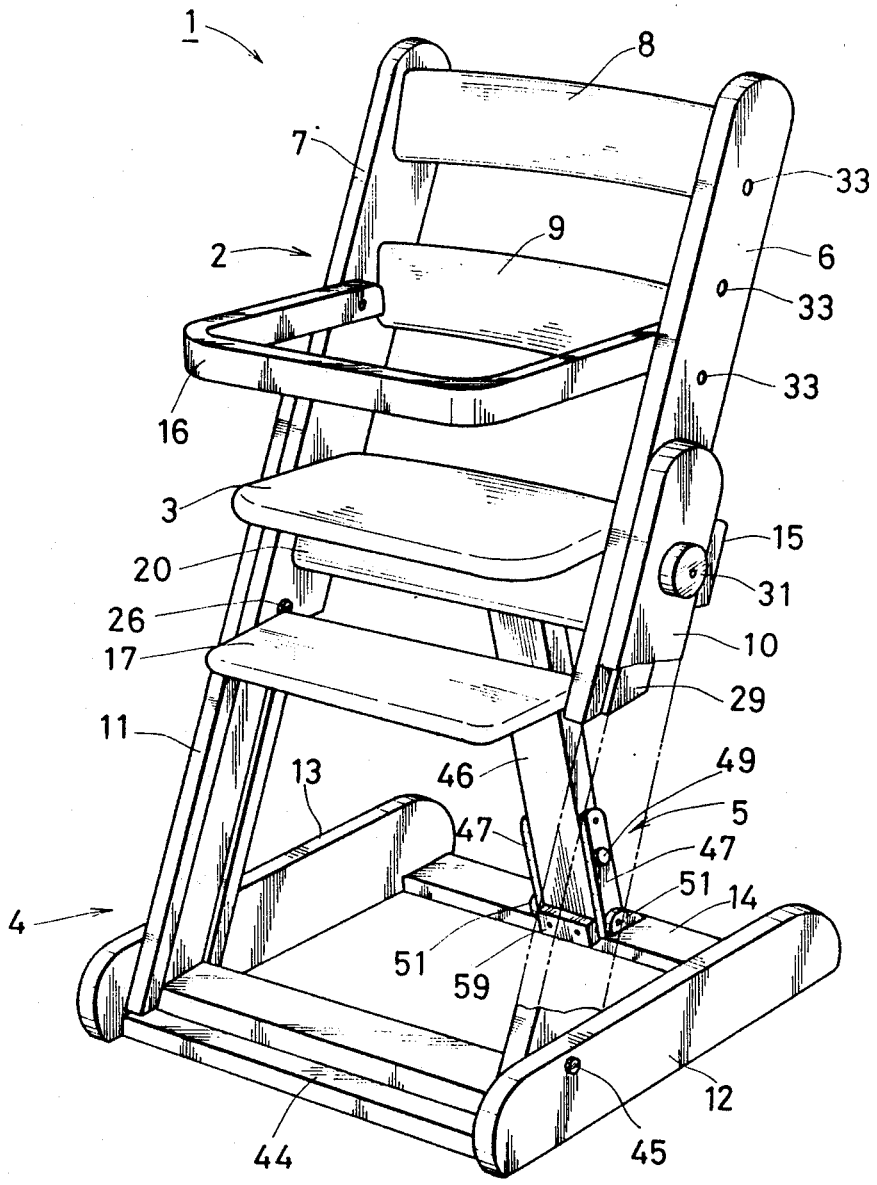
FIG. 1 is a perspective view showing an embodiment of this invention.
Figure 2:
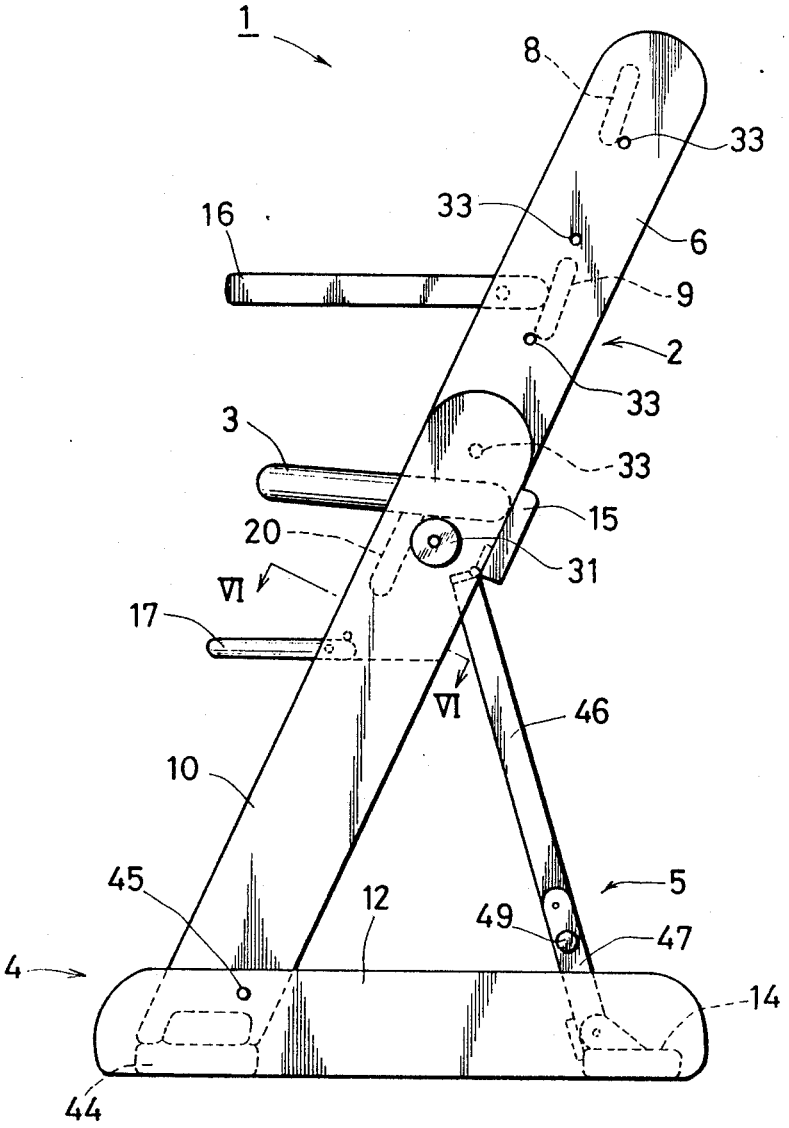
FIG. 2 is a side view of the embodiment of FIG. 1.

Referring first to FIGS. 1 and 2 the present high chair 1 comprises a backrest member 2 and a seat member 3 which constitute a seat section, a support member 4 disposed to overlap the backrest member 2 and supporting the backrest member for a substantially vertical sliding movement, and a raised position fixing device 5 for fixing the support member 4 in its raised position. In addition, the support member 4 is shown partly broken away in FIG. 1 in order to clarify the construction of the raised position fixing device 5.

The backrest member 2 includes left-hand and right-hand side backrest frames 6 and 7 extending vertically on the left-hand and right-hand sides of a child sitting on the chair, and central backrest frames 8 and 9 extending widthwise and fixed at their opposite ends to said left-hand and right-hand side backrest frames 6 and 7.

The support member 4 includes left-hand and right-hand side support frames 10 and 11 extending vertically and disposed to overlap said left-hand and right-hand side backrest frames 6 and 7, and a central base frame 14 fixed to the rear portions of longitudinal left-hand and right-hand side base frames 12 and 13. The upper ends of the left-hand and right-hand support side frames 10 and 11 are interconnected by a connecting member 15 extending horizontally across the width of the chair.

A table frame 16 and a footrest 17 are connected between the left-hand and right-hand side backrest frames 6 and 7 for supporting a table on the frame 16 and a child's feet on the footrest 17. The table frame 16, seat member 3 and footrest 17 are installed so that they can be turned until their lateral edges are substantially parallel to the left-hand and right-hand side backrest frames 6 and 7. This will now be described in more detail with reference to FIGS. 3 to 5. As best seen in FIG. 2, the support frame 10, 11 extends upwardly at a given angle relative to the horizontal and the backrest and seat frame 6, 7 also extends upwardly at the same given angle so that both frames are in line with each other.

Figure 3:
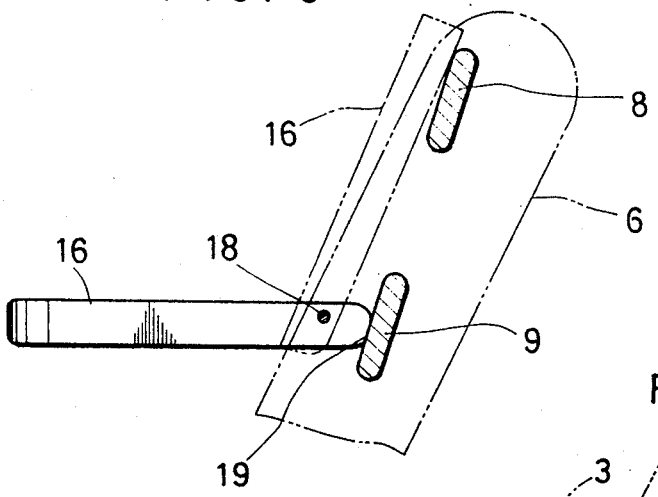
FIG. 3 is a side view showing an arrangement for attaching a table frame shown in FIG. 1 to the backrest frame members.

FIG. 3 shows an arrangement for attaching the table frame 16, whereby the left-hand side backrest frame 6 is shown in phantom lines for the sake of convenience. The table frame 16 is turnably connected between the left-hand and right-hand side frames 6 and 7 by a pin 18. In the normal condition, the lower portion 19 of the rear end surface of the table frame 16 abuts against the central backrest frame 9, whereby the lower portion 19 of the rear end surface of the table frame 16 is inhibited from turning downwardly. If the table frame 16 is turned clockwise from the illustrated state, its state of contact with the central backrest frame 9 is canceled and eventually its side edges are turned until it is substantially parallel to the left-hand and right-hand side backrest frames 6 and 7, as shown in phantom lines.

Figure 4:
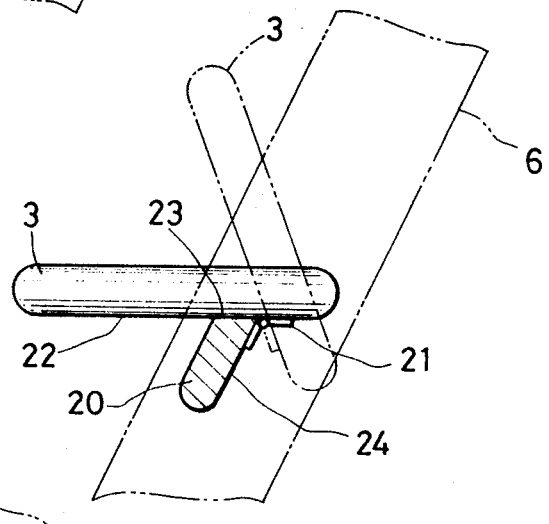
FIG. 4 is a side view showing an arrangement for attaching a seat member shown in FIG. 1 to the backrest frame members.

FIG. 4 is a view showing an arrangement for attaching the seat member 3 to a seat support frame 20 extending widthwise and fixed between the left-hand and right-hand side backrest frames 6 and 7, whereby the seat member 3 is hinged to said seat support frame 20 by a hinge 21. In the normal condition, the lower surface 22 of the seat member 3 abuts against the upper surface 23 of the seat support frame 20, whereby the seat member 3 is inhibited from turning downwardly. If the seat member 3 is turned clockwise from the illustrated state, eventually its side edges will be positioned parallel to the left-hand and right-hand side backrest frames 6 and 7. In FIG. 4, the seat member 3 is shown also by phantom lines in an intermediate position during the turning movement.

Figure 5:
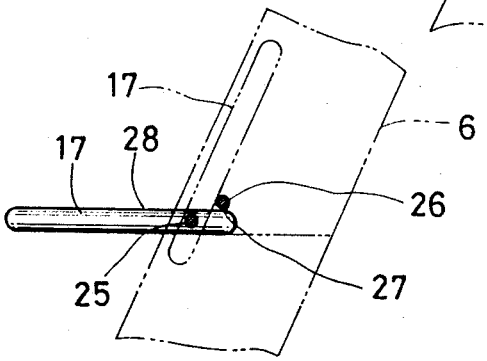
FIG. 5 is a side view showing an arrangement for attaching a footrest shown in FIG. 1 to the backrest frame members.

FIG. 5 is a view showing an arrangement for hinging the footrest 17 between the left-hand and right-hand side backrest frames 6 and 7 by a hinging a pin 25. A pin 26 is provided at a position above and behind the hinging pin 25 for holding the footrest 17 in a normal horizontal position wherein a portion 27 of the upper surface of the footrest 17 located rearwardly of the pin 25 abuts against the pin 26, thereby inhibiting the downward turning of the footrest 17. If the footrest 17 is turned clockwise from the state shown in FIG. 5, eventually the portion 28 of the upper surface of the footrest 17 located forwardly of the pin 25 abuts against the pin 26. In this state, the lateral edges of the footrest 17 are positioned substantially parallel to the left-hand and right-hand side backrest frames 6 and 7, as shown in phantom lines.

Figure 6:
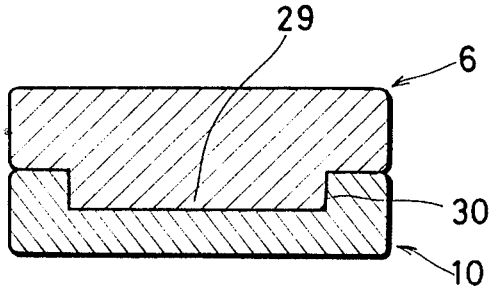
FIG. 6 is a sectional view taken along the line VI—VI in FIG. 2.

FIG. 6 is a view taken along the line VI—VI in FIG. 2, showing the region where the left-hand side backrest frame 6 and the left-hand side support frame 10 overlap each other. The left-hand side backrest frame 6 is provided with a raised portion or tongue 29 also seen in FIG. 1. The left-hand side support frame 10 is provided with a vertically extending guide groove 30 for receiving the tongue 29. The right-hand side backrest frame 7 and the right-hand side support frame 11 are also provided with the same tongue and groove arrangement. Thus, the left-hand and right-hand side backrest frames 6 and 7 are vertically or rather axially slidable with the tongues 29 guided in the grooves 30.

Figure 7:
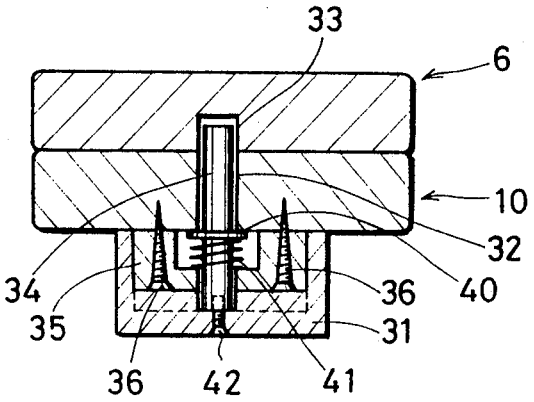
FIG. 7 is a sectional view, taken from above, showing a structure associated with a knob 2; shown in FIGS. 1 and 2.

Referring to FIGS. 1 and 2, the left-hand side support frame 10 has a knob 31 attached to the upper portion thereof. Similarly, though not seen in the figures, the right-hand side support frame 11 has the same knob attached to the upper portion thereof. FIG. 7 is a sectional view, taken from above, showing the construction of the knob 31 shown in FIGS. 1 and 2.

Referring to FIGS. 1 and 7 in the region where the left-hand side backrest frame 6 and the left-hand side support frame 10 overlap each other, the left-hand side support frame 10 has through-hole 32. The portion of the left-hand side backrest frame 10 which can be opposed to the through-hole 32, has a plurality of vertically aligned engaging holes 33. A lock pin 34 is fixed to the knob 31 by a screw 42 for insertion through the hole 32 into any one of said engaging holes 33. As shown in FIG. 7, when the front end of the lock pin is positioned in the engaging hole 33 of the left-hand side backrest frame 6, the slide movement of the left-hand side backrest frame 6 is inhibited, whereby other the height of the seat section is fixed. If the lock pin 34 is moved downwardly from the state shown in FIG. 7, it is disengaged from the engaging hole 33. When the lock pin 34 is out of engagement with the engaging hole 33, the sliding movement of the left-hand side backrest frame 6 becomes possible and the height of the seat section can be changed.

Figure 8:
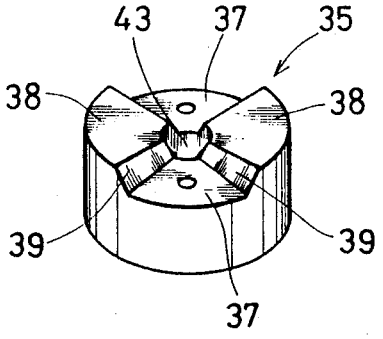
FIG. 8 is a perspective view of a lock guide member shown in FIG. 7.

In the illustrated embodiment the moving of the lock pin 34 is facilitated by the following construction. As shown in FIG. 7, a lock condition control means in the form of a lock guide member 35 surrounding the lock pin 34, is fixed to the left-hand side backrest frame 6 by screws 36. FIG. 8 is a perspective view of this lock guide member 35 having an insertion hole 43 substantially at the center thereof for inserting the lock pin 34 therein. Raised portions 38 and recessed portions 37 alternate around the insertion hole 43. The recessed and raised portions 37 and 38 are connected to each other by inclined surfaces 39.

As shown in FIG. 7, the knob 31 surrounds the aforesaid lock guide member 35. Further, the knob 31 has recessed and raised portions for cooperating with the recessed and raised portions 37 and 38 of the lock guide member 35. In the state shown in FIG. 7, the recessed and raised portions of the knob 31 are in engagement with the recessed and raised portions of the lock guide member and in this state the front end of the lock pin 34 is positioned in the engaging hole 33 to prevent relative movement between members 6 and 10.

The lock pin 34 has a spring support flange 40 fixed thereto and a spring 41 is disposed between the spring support flange 40 and the lock guide member 35. The spring 41 constantly urges the lock pin 43 in one direction, i.e., a direction which causes it to engage an engaging hole 33.

Figure 9:
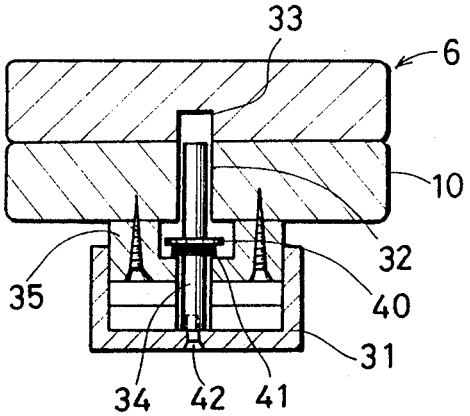
FIG. 9 is a sectional view showing the knob 31 rotated from its state shown in FIG. 7.

Since the recessed and raised portions 37 and 38, as shown in FIG. 8, are connected to each other by the inclined surfaces 39, it is possible to rotate the knob 31 for lifting the pin 34 out of the hole 33. FIG. 9 shows a state in which the raised portions of the knob 31 and the raised portions of the lock guide member 35 abut against each other by rotating the knob 31. As shown, in this state, the lock pin 34 is out of engagement with the engaging hole 33, so that the slide movement of the left-hand side backrest frame 6 is possible.

The mechanism shown in FIGS. 7 to 9 is also employed between the right-hand side backrest frame 7 and the right-hand side support frame 11. Thus, the high chair shown in FIG. 1 is adapted to have the height of its seat section 3 adjusted according to the growth of a child. Usually, the height of the seat section will be gradually reduced according to the growth of a child. Further, the greater the number of engaging holes, the easier it is to make fine adjustments of the height. In the embodiment shown in FIG. 10, the arrangement is such that when the uppermost engaging hole 33 is engaged by the lock pin 34, the height of the seat section is equal to the height of a low chair. Thus, the high chair shown in FIG. 1 has an additional function of serving as a low chair.

Figure 10:
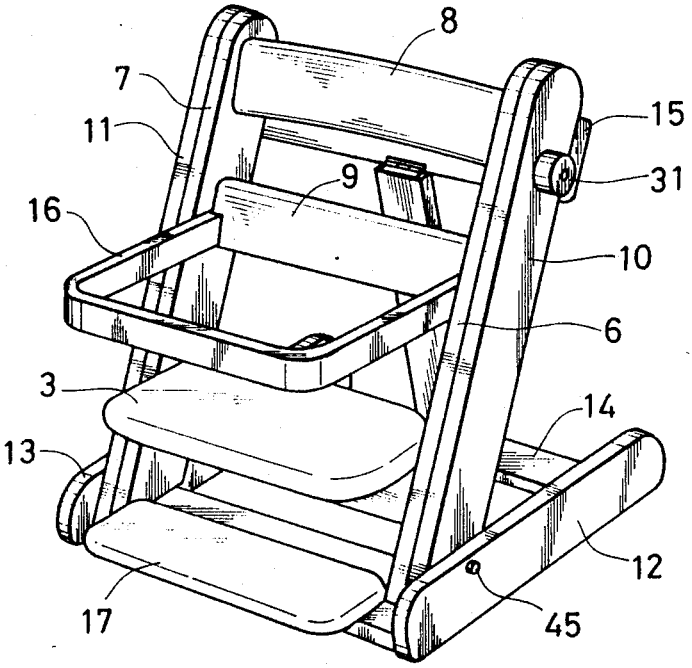
FIG. 10 is a perspective view showing a backrest member moved downwardly from its state shown in FIG. 1 to its lowermost position until the level of the seat section is reduced to that equal to the level of the seat section of a low chair.

Referring to FIGS. 1 and 10, a front base frame member 44 is fixedly connected between the front portions of the left-hand side and right-hand side base frame members 12 and 13. The front base frame member 44 cooperates with the central base frame member 14 to fix the distance between the left-hand and right-hand side base frame members 12 and 13 and to form a chair base with the side members 12 and 13.

Figure 11:
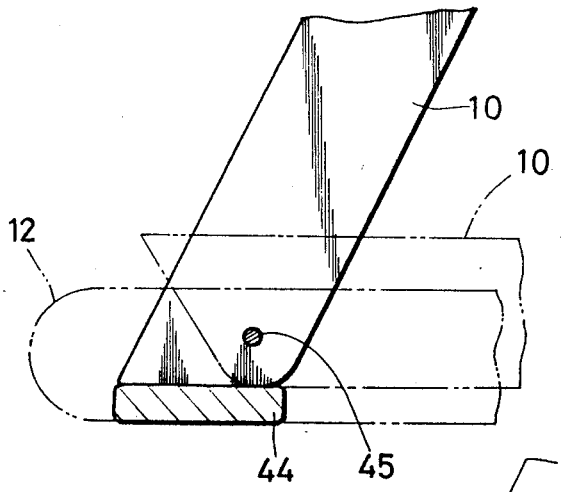
FIG. 11 is a side view showing an arrangement for attaching a left-hand side support frame shown in FIG. 1 to a base frame.

FIG. 11 is shows an arrangement for attaching the left-hand support frame 10 to the base. The lower portion of the left-hand side support frame 10 is hinged to the left-hand side base frame 12 by pin 45. Similarly, the right-hand support frame 11 is hinged to the right-hand side base frame 13. The left-hand and right-hand side support frames 10 and 11 are turnable until they extend substantially in parallel to the left-hand and right-hand side base frame members 12 and 13, respectively. In FIG. 11, the state assumed by the left-hand side support frame 10 when it has been thus turned is shown in phantom lines. In the normal condition of use, the left-hand and right-hand side support frames 10 and 11 are fixed in their raised position by the raised position fixing means 5, as shown in FIG. 1.

Figure 12:
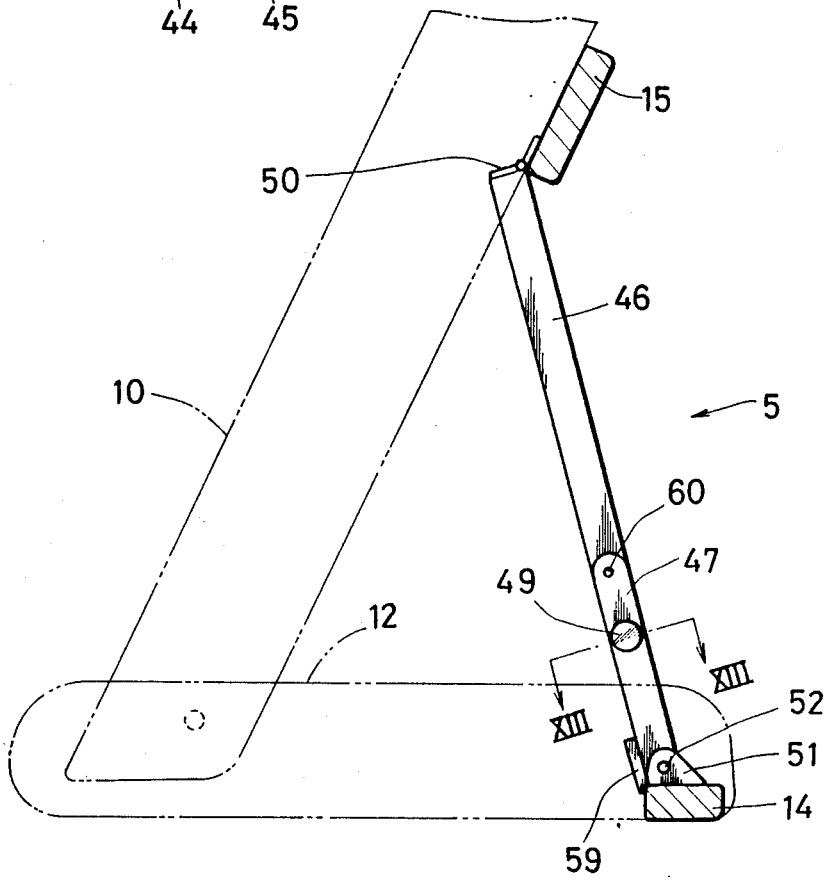
FIG. 12 is a side view showing a raised position fixing device also shown in FIG. 1.

FIG. 12 is a side view of the raised position fixing device 5 including an upper hinged turnably member 46, lower turnable strut 47, and turning movement inhibiting pins 48 (see FIG. 13) each fixed to a knob 49. The upper turnable strut 46 is hinged at its upper end to the widthwise connecting member 15 by a hinge 50. Further, the lower end of the strut 46 extends almost to the central base frame member 14, as shown in FIG. 1.

Two lower turnable strut members 47 are constructed to hold the lower portion of the upper turnable strut 46 therebetween, and are turnably connected at their lower ends to lobe members 51 by pins 52, said lobe members 51 being fixed to the central base frame member 14. The upper ends of the lower turnable members 47 are turnably connected to the upper turnable strut 46 by a pin 60.

Figure 13:
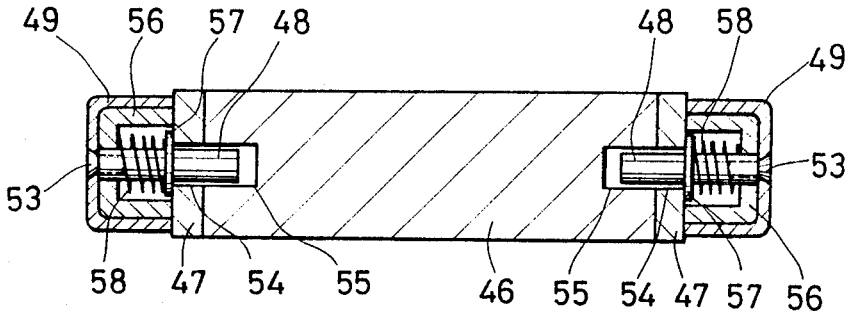
FIG. 13 is a sectional view taken along the line XIII—XIII in FIG. 12.

Referring to FIG. 13 which is a sectional view taken along the line XIII—XIII in FIG. 12, each knob 49 has a turning movement inhibiting pin 48 fixed thereto as by a screw 53. Each lower turnable member 47 has a through-hole 54 for receiving said turning movement inhibiting pin 48. The upper turnable strut 46 has engaging holes 55 for receiving the front end portions of the turning movement inhibiting pins 48. The knob 49, as shown in FIG. 13, covers a spring storing cap 56 which is fixed to the lower turnable member 47. A spring 58 is installed between the spring storing cap 56 and a spring support 57 fixed to the turning movement inhibiting pin 48, said spring constantly urging the turning movement inhibiting pin 48 in one direction, i.e., a direction which causes it to engage the engaging hole 55 in the strut 46.

In the state shown in FIG. 13, the turning movement inhibiting pin 48 extends through the hole 54 and into the engaging hole 55, thereby inhibiting the turning movement of the upper strut 46 and of the lower turnable members 47. In other words, the raised position fixing device 5 fixes the left-hand and right-hand side support frames 10 and 11 in their raised position.

Figure 14:
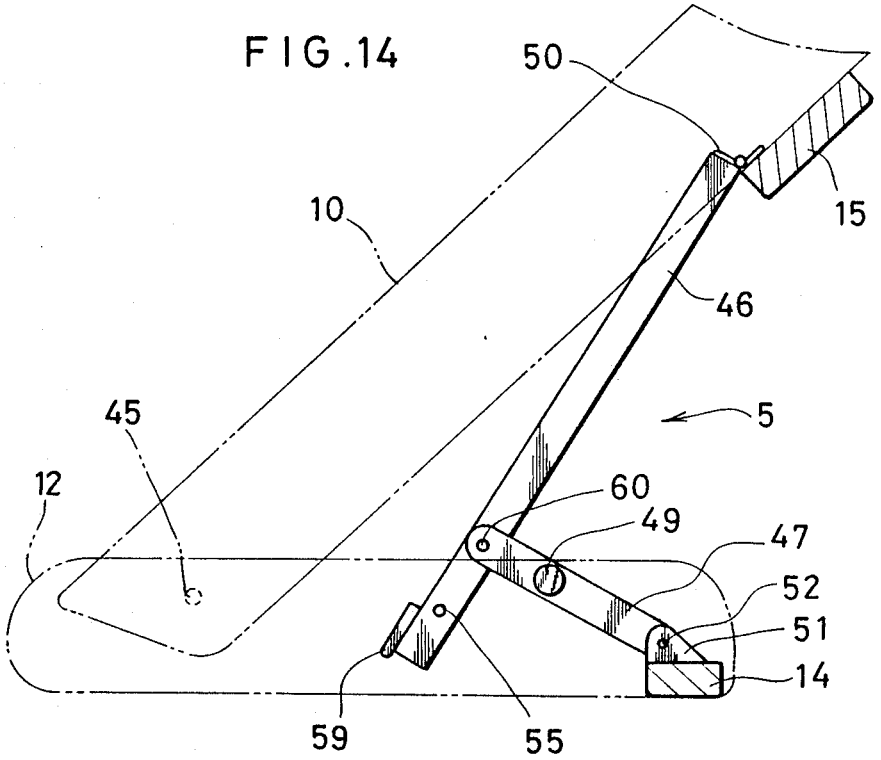
FIG. 14 is a side view showing the left-hand side support frame in an intermediate state which the support frame may assume during rotation from the state of FIG. 12 into the state shown in FIG. 15.

If each knob 49 is pulled to compress the spring 58, the turning movement inhibiting pin 48 is disengaged from the engaging hole 55. Therefore, it becomes possible for the upper struts 46 and the lower turnable members 47 to turn for a folding operation. That is, the left-hand and right-hand side support frames 10 and 11 can be lowered from their raised position. FIG. 14 shows the left-hand and right-hand side support frames 10 and 11 being turned if the locking between the upper strut 46 and the lower turnable members 47 is canceled. A comparison between FIGS. 12 and 14 shows that the left-hand and right-hand side support frames 10 and 11 are turned clockwise around the pin 45, that the upper turnable strut 46 is turned clockwise around the hinge 50 and that the lower turnable members 47 are turned counterclockwise around the pin 52.

In addition, as shown in FIGS. 1, 12 and 14, a stopper 59 is attached to the lower end of the upper turnable strut 46. The stopper 59 abuts against the central base frame 14, thereby defining the terminal end of the turning movement of the upper turnable strut 46 in one direction. The arrangement is such that when the stopper 59 abuts against the central base frame 14, the through-hole 54 of the lower turnable member 47 is aligned with the engaging hole 55 of the upper turnable strut 46.

Figure 15:
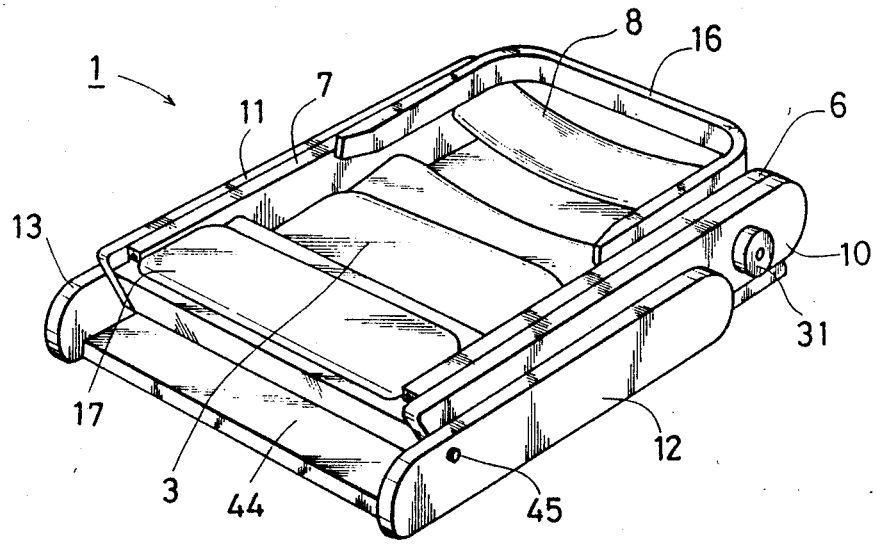
FIG. 15 is a perspective view showing the folded state of the high chair shown in FIG. 1.

FIG. 15 is a perspective view showing the folded state of the high chair 1 of FIG. 1. This folded state is obtained by performing the following operation. Referring to FIG. 1 together with FIG. 15, first, the knobs 31 attached to the upper portions of the left-hand and right-hand side support frames 10 and 11 are turned to make the left-hand and right-hand side backrest frames 6 and 7 ready for a sliding movement. The left-hand and right-hand side backrest frames 6 and 7 are then lowered to their lowermost position. Then, the locked state established by the raised position fixing device 5 is canceled and the left-hand and right-hand side support frames 10 and 11 are tilted backward. Finally, the table frame 16, seat member 3 and footrest 17 are turned to provide the state shown in FIG. 15.

As shown in FIG. 15, in the folded state of the high chair 1, the left-hand and right-hand base frames 12, 13, the left-hand and right-hand side support frames 10, 11, the left-hand and right-hand side backrest frames 6, 7, the slide arms of the table frame 16, the lateral edges of the seat member 3 and of the footrest 17 extend in parallel to each other, and the height has been reduced because of the lowering of the left-hand and right-hand side backrest frames 6 and 7; thus, the volume needed for attained in the folded state has been minimized. Therefore, the space for storing the high chair 1 is minimized.

Figure 16:
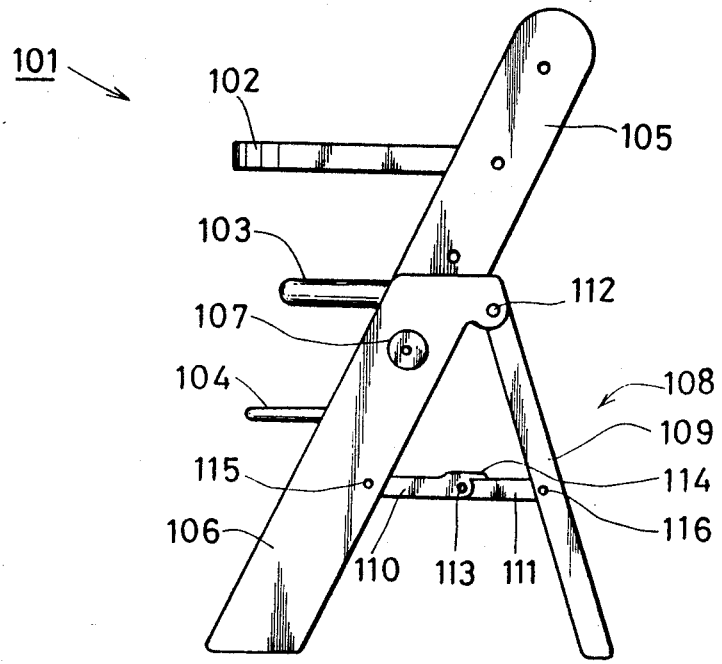
FIG. 16 is a side view showing another embodiment of the invention.

FIG. 16 is a side view of another embodiment of the invention, illustrating a high chair 101 with certain features that are different from the features of the high chair 1 described above, with regard to the construction of the raised position fixing device. Otherwise the second embodiment is basically the same as the first embodiment. More particularly, the left-hand side backrest frame 105 and right-hand side backrest frame which are provided with a table frame 102, a seat member 103 and a footrest 104 are slidably supported by the left-hand side support frame 106 and right-hand side support frame. The raised position of the left-hand side support frame 106 and right-hand side support frame is fixed by a raised position fixing device 108. The knob 107 performs the same function as the knob 31 described above for the height adjustment. For this purpose the backrest frames 105 are also provided with the same holes as are shown in FIG. 1 at 33.

The raised position fixing device 108 comprises a left-hand side prop member 109 and a right-hand side prop member, a left-hand side front link 110 and a right-hand side front link, and a left-hand side rear link 111 and a right-hand side rear link. Since the arrangement associated with the left-hand side prop member 109 is basically the same as the arrangement associated with the right-hand side prop member, the arrangement associated with the left-hand side prop member 109 alone will be described below.

The the upper end of the left-hand side prop member 109 is hinged by a hinge pin 112 to the left-hand side support frame 106 and is placed at its lower end directly on the floor. The left-hand side front link 110 is hinged at its front end to the left-hand side support frame 106 by a pin 115. The left-hand side rear link 111 is is hinged at its rear end to the left-hand side prop member 109 by a pin 116. Links 110 and 111 are pivoted to each other by a pivot joint 113. When the left-hand side front and rear links 110 and 111 are arranged substantially in a line, as shown in FIG. 16, the angle between the left-hand side support frame 106 and the left-hand side prop member 109 does not become greater any more, with the result that the raised position of the left-hand side support frame 106 is fixed. In addition, the left-hand side front link 110 is formed with a stopper 114 abutting against the left-hand side rear link 111 when the left-hand and right-hand side front and rear links 110 and 111 are arranged substantially in a line. When it is desired to fold the high chair 101, the left-hand side front and rear links 110 and 111 are turned upward so that the left-hand side support frame 106 and the left-hand side prop member 109 are moved toward each other.

In the first embodiment described above, the high chair 1 has been constructed to have an additional function of serving as a low chair. Both embodiments can serve as a low chair, please see the knobs 31 and 107. However, if it is not intended to use the high chair as a low chair, there is no need to construct it so that the height of the seat section can be reduced to one equal to the height of the seat section of a low chair.

Further, in the first embodiment described above, the locked state between the left-hand and right-hand side backrest frames 6, 7 and the left-hand and right-hand side support frames 10, 11 is canceled by turning the knobs 31 fixed to the lock pins 34. However, such knobs 31 are not absolutely necessary. That is, lock pins may be simply inserted or extracted by hand.

In the first embodiment described above, the table frame 16, seat member 3 and footrest 17 have been turnably installed. However, if it is not necessary to fold the high chair 1, the table frame 16, seat member 3 and footrest 17 may be fixedly connected to the left-hand and right-hand side backrest frames 6 and 7. For the same reason, the left-hand and right-hand side support frames 10 and 11 may be fixedly connected to the left-hand and right-hand side base frames 12 and 13. In that case, the construction for fixing the left-hand and right-hand side support frames 10 and 11 in their raised position can be simplified. Further, the high chair may be one having no table frame 16 or footrest 17.

Figure 17:
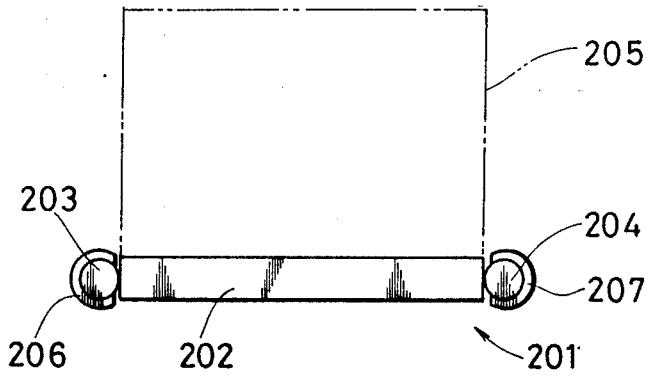
FIG. 17 is a schematic plan view showing other examples of a backrest member and a support member.

In the first embodiment described above, the backrest member 2 has been described as including left-hand and right-hand side backrest frames 6, 7 and the central backrest frames 8 and 9, and the support member 4 has been described as including the left-hand and right-hand side support frames 10 and 11. However, other constructions may be employed as the backrest member and the support member. FIG. 17 is a schematic plan view showing other examples of a backrest member and a support member, whereby the back rest member 201 includes a single planar plate-like member 202 and round bars 203 and 204 fixed on opposite sides of said member 202. Shown in phantom lines is a seat member. The support member includes two pipes 206 and 207 having the round bars 203 and 204 vertically slidably received therein.

Figure 18:
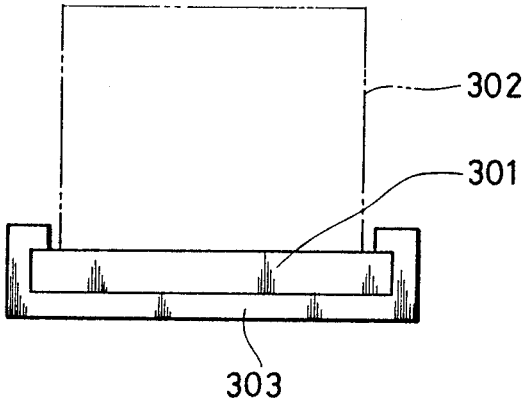
FIG. 18 is a schematic plan view showing a further examples of a backrest member and a support member.

FIG. 18 is a schematic plan view showing another example of a backrest member and a support member, whereby the backrest member 301 is a single planar plate-like member. The support member includes a C-shaped member 303 configured to surround the back and lateral sides of the backrest member 301. The C-shaped member 303 supports the backrest member 301 for vertical slide movement. Shown at 304 in phantom lines is a seat member.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A foldable high chair for a child, comprising a seat structure for supporting a child, a support structure for carrying said seat structure, and a position fixing device connected to said support structure for holding said support structure in a raised position for using said chair, said seat structure comprising two flat backrest frame members having first outer surfaces facing away from each other, a seat hinged to and between said two flat backrest frame members, said seat having lateral edges extending in parallel to said two flat backrest frame members in a folded condition of said chair, said first cross means interconnecting said two flat backrest frame members for forming a seat and backrest first frame having a given width between said first outer surfaces, said support structure comprising two flat support frame members having second inner surfaces facing toward each other, second cross means interconnecting said flat support frame members for forming a support structure second frame having a clearance between said second inner surfaces sufficient for receiving said given width of said first frame in said second frame with a sliding fit between said first outer surfaces and said second inner surfaces, and elevation control means (31, 35) operatively arranged for cooperation with said first and second frames for fixing an elevational position of said first frame relative to said second frame, said first frame and said second frame extending upwardly at a same given angle relative to the horizontal so that both frames are in line with each other.

2. The foldable high chair of claim 1, further comprising a footrest hinged to and between said two flat backrest frame members, said footrest also having lateral edges extending in parallel to said first and second frames in said folded condition of said chair.

3. The foldable high chair of claim 1, further comprising tongue and groove guide means in said first and second surfaces for guiding a sliding movement of said first and second frames longitudinally relative to each other.

4. The foldable high chair of claim 1, further comprising table frame means including side arms hinged to and between said two flat backrest frame members, said side arms extending in parallel to said two flat backrest frame members and in parallel to said two flat support frame members in the folded condition of said chair.

5. The foldable high chair of claim 1, wherein said elevation control means comprise a row of spaced lock holes in each of said two flat backrest frame members, a lock pin movable in a through-hole in each of said two flat support frame members for engagement in any one of said spaced lock holes, and spring means for urging said lock pin into any one of said lock holes.

6. The foldable high chair of claim 5, further comprising a knob fixed to one end of said lock pin, said knob having raised and recessed portions arranged in a circle to surround said lock pin, lock condition control means connected to each of said flat support frame members and also provided with raised and recessed portions for cooperation with said raised and recessed portions of said knob in such a way that a free end of said lock pin is inside one of said lock holes when the raised and recessed portions of said knob are engaged with the raised and recessed portions of said lock condition control means, whereby an elevational position of said first frame is fixed relative to said second frame, and so that said lock pin is disengaged from said one lock hole, when said knob is rotated to cause the raised portions of said knob to abut against the raised portions of said lock condition control means, thereby allowing a sliding movement of said first frame guided by said second frame at least between an uppermost position and a lowermost position.

7. The foldable high chair of claim 1, wherein said support structure further comprises a base frame including a left-hand side member and a right-hand side member disposed on a floor, and third cross means fixed at opposite ends to said left-hand and right-hand side members for forming said base frame, means hinging said base frame to said second frame for permitting a relative hinging motion between said second frame and said base frame into a folded position, wherein said base frame and said second frame are in parallel to each other, said position fixing device including an upper strut hinged at its upper end to said second cross means, and lower strut means disposed to overlap said upper strut, said lower strut means being hinged at its upper end to said upper strut and at its lower end to said base frame, and a stop pin positioned between said upper strut and said lower strut means in a region where said upper strut and said lower strut means overlap each other for inhibiting a buckling of said upper strut and lower strut means when said stop pin interlocks said upper strut and said lower strut means.

8. The foldable high chair of claim 1, wherein said support structure further comprises a left-hand side prop member and a right-hand side prop member which are hinged at their upper ends to said second frame and placed at their lower ends directly on a floor, a left-hand buckling link and a right-hand buckling link hinged to said second frame and to the respective prop member, each buckling link having tow link elements (110, 111), pivot means interconnecting the link elements for folding said link elements toward each other, and stop means (114) for limiting a buckling movement of said link elements.

9. The foldable high chair of claim 1, wherein said two flat backrest frame members and said two flat support frame members comprise four flat boards of substantially equal length so that said first frame and said second frame are also of substantially equal length, said first frame being received substantially completely in said second frame in a lowermost position of said first frame.

* * * * *

UNITED STATES PATENT AND TRADEMARK OFFICE
CERTIFICATE OF CORRECTION

PATENT NO. : 4,958,885

DATED : September 25, 1990

INVENTOR(S) : Kenzou Kassai

It is certified that error appears in the above-identified patent and that said Letters Patent is hereby corrected as shown below:

Column 9, lines 17-45

Please replace claim 1 by allowed claim 1 as follows:

A foldable high chair for a child, comprising a seat structure for supporting a child, a support structure for carrying said seat structure, and a position fixing device connected to said support structure for holding said support structure in a raised position for using said chair, said seat structure comprising two flat backrest frame members having first outer surfaces facing away from each other, a seat hinged to and between said two flat backrest frame members, said seat having lateral edges extending in parallel to said two flat backrest frame members in a folded condition of said chair, and first cross means interconnecting said two flat backrest frame members for forming a seat and backrest first frame having a given width between said first outer surfaces, said support structure comprising two flat support frame members having second inner surfaces facing toward each other, second cross means interconnecting said flat support frame members for forming a support structure second

UNITED STATES PATENT AND TRADEMARK OFFICE

CERTIFICATE OF CORRECTION

PATENT NO. : 4,958,885

DATED : September 25, 1990

INVENTOR(S) : Kenzou Kassai

It is certified that error appears in the above-identified patent and that said Letters Patent is hereby corrected as shown below:

frame having a clearance between said second inner surfaces sufficient for receiving said given width of said first frame in said second frame with a sliding fit between said first outer surfaces and said second inner surfaces, and elevation control means operatively arranged for cooperation with said first and second frames for rigidly but adjustably fixing an elevational position of said first frame relative to said second frame so that said first frame and said second frame extend upwardly at a same given angle relative to the horizontal in an adjusted position and both frames can slide in line with each other for an adjustment, and wherein said two flat backrest frame members and said two flat support frame members comprise four flat boards of substantially equal length so that said first frame and said second frame are also of substantially equal length, said first frame being received substantially completely in said second frame in a lowermost position of said first frame and in a fully folded condition.

Column 9, lines 51-55
Please replace claim 3 by allowed claim 3 as follows.

UNITED STATES PATENT AND TRADEMARK OFFICE

CERTIFICATE OF CORRECTION

PATENT NO. : 4,958,885

DATED : September 25, 1990

INVENTOR(S) : Kenzou Kassai

It is certified that error appears in the above-identified patent and that said Letters Patent is hereby corrected as shown below:

The foldable high chair of claim 1, wherein said elevation control means comprise tongue and groove guide means in said first and second surfaces for guiding an elevational position adjusting sliding movement of said first and second frames longitudinally relative to each other and for enforcing that said first and second frames extend at said 'same given angle.

Column 9, lines 62-65, Column 10, lines 1-3
Please replace claim 5 by allowed claim 5 as follows.

The foldable high chair of claim 1, wherein said elevation control means comprise a row of spaced lock holes in at least one of said two flat backrest frame members, through-hole means in at least one of said two flat support frame members cooperating with said at least one back-rest frame member, lock pin means extendable through said through-hole means for engagement in any one of said spaced lock holes, and spring means for releasably urging said lock pin means into any one of said lock holes.

UNITED STATES PATENT AND TRADEMARK OFFICE

CERTIFICATE OF CORRECTION

PATENT NO. : 4,958,885

DATED : September 25, 1990

INVENTOR(S) : Kenzou Kassai

It is certified that error appears in the above-identified patent and that said Letters Patent is hereby corrected as shown below:

Column 10, lines 57-64
Please cancel claim 9.

Signed and Sealed this

Thirty-first Day of December, 1991

*Attest:*

HARRY F. MANBECK, JR.

*Attesting Officer*

*Commissioner of Patents and Trademarks*